US005906116A

United States Patent [19]

Kim et al.

[11] Patent Number: 5,906,116

[45] Date of Patent: May 25, 1999

[54] CLOTHES WASHING MACHINE HAVING A PULSATOR WITH A WATER-SPURTING DUCT

[75] Inventors: Young-Chul Kim; Jae-Ryoung Park, both of Suwon, Rep. of Korea

[73] Assignee: Samsung Electronics Co., Ltd., Suwon, Rep. of Korea

[21] Appl. No.: 09/050,022

[22] Filed: Mar. 30, 1998

[51] Int. Cl.[6] ..... D06F 17/10

[52] U.S. Cl. ..... 68/53; 68/134

[58] Field of Search ..... 68/53, 134

[56] References Cited

U.S. PATENT DOCUMENTS 4,420,952 12/1983 Brenner et al. ..... 68/53
5,829,276 11/1998 Suh et al. ..... 68/53

FOREIGN PATENT DOCUMENTS 59-191370 12/1984 Japan .
8-229276 9/1996 Japan .
9-70375 3/1997 Japan .

*Primary Examiner*—Philip R. Coe
*Attorney, Agent, or Firm*—Burns, Doane, Swecker & Mathis, L.L.P.

[57] ABSTRACT

In a clothes washing machine, washing water is caused to spurt upwardly from the center of a pulsator, so as to disperse laundry gathered above the center of the pulsator. A washing water spurting apparatus includes guide ducts mounted on an underside of the pulsator. Each guide duct has an upper case, a lower case, and a first assembling mechanism for easily assembling and detaching the upper case and the lower case to and from each other. There is also a second assembling mechanism for assembling the guide duct to the underside of the pulsator so that the guide duct can rotate together with the pulsator.

11 Claims, 9 Drawing Sheets

130
137
139
138
h t 201
202
200

139
138
137
137a 231
231a

237

CLOTHES WASHING MACHINE HAVING A PULSATOR WITH A WATER-SPURTING DUCT

BACKGROUND OF THE INVENTION

1) Field of the Invention

The present invention relates to a clothes washing machine, and more particularly to a washing machine having a spin basket in which a pulsator is mounted for rotation.

2) Prior Art

Generally, a clothes washing machine is an appliance for washing laundry, in which a pulsator rotates to generate washing current for applying impact to the laundry, thereby washing the laundry.

FIG. 1 shows such a conventional washing machine. As shown, the conventional washing machine includes a housing 10 forming the outer appearance of the washing machine, a tub 11 installed in the housing 10 for containing a predetermined amount of washing water required for washing the laundry, and a spin basket 12 rotatably installed in the tub 11. A pulsator 13 for generating the washing current is mounted on the inner bottom of the spin basket 12, and a driving mechanism 14 for driving the spin basket 12 and the pulsator 13 is arranged under the tub 11. The driving mechanism 14 includes a motor 14*a* and a transmission 14*b*. The motor 14*a* generates the driving power, and the transmission 14*b* selectively drives the pulsator 13 and the spin basket 12 by means of the rotating force of the motor 14*a* transferred through a belt 14*c*.

Further, a drain hose 15 is provided at one side position under the tub 11 and extends out of the housing 10 to drain the washing water from the tub 11.

In the conventional washing machine as constructed above, when an electric power is applied after the laundry is put in the spin basket 12, the washing water is supplied into the spin basket 12 and then the pulsator 13 is rotated in one direction or alternately in opposite directions (i.e., oscillated) by the motor 14*a* to generate the washing current. The laundry flows according to the washing current and is washed by the friction occurring between the clothes and the washing water and the inner wall of the spin basket 12.

However, in such a conventional washing machine, the laundry usually becomes tangled together above the center of the pulsator to thereby diminish the washing performance. That is, the centrifugal force caused by the rotation of the pulsator drives the washing water toward the wall of the spin basket. As a result, the washing water is deeper at the outer periphery of the pulsator, than at the center thereof. Therefore, the clothes come into closer contact above the center of the pulsator. Such gathered laundry above the center of the pulsator goes on rotating in one direction or alternately in opposite directions along with the pulsator, so that the laundry becomes severely tangled together, thereby diminishing the washing performance of the washing machine and even damaging the laundry.

SUMMARY OF THE INVENTION

The present invention has been made to overcome the above described problems of the prior art, and accordingly it is an object of the present invention to provide a washing machine, in which washing water spurts upwardly from the center of a pulsator, so as to disperse the laundry gathered thereabove.

It is an object of the present invention to provide a clothes washing machine, in which a guide duct can be easily assembled.

To achieve the above object, the present invention provides a clothes washing machine comprising:

a housing;

a spin basket mounted in the housing;

a pulsator rotatably mounted at a bottom of the spin basket; and a washing water spurting apparatus including at least one guide duct and a spurt cap, the guide duct being disposed on an underside of the pulsator to rotate together with the pulsator for guiding washing water from an inlet of the guide duct toward an outlet thereof located at a center of the pulsator, the spurt cap being disposed at the center of the pulsator to eject the washing water exiting the guide duct upwardly from the center of the pulsator. The guide duct comprises an upper case, a lower case, and an assembling means for easily assembling and detaching the upper case and the lower case with and from each other.

Preferably, the upper case includes a top plate, an upper inner plate and an upper outer plate, the upper inner plate and the upper outer plate forming downwardly depending side walls of the upper case; the lower case having a bottom plate, a lower inner plate, and a lower outer plate, the lower inner plate and the lower outer plate forming upwardly extending side walls of the lower case; the lower inner plate and the lower outer plate being inserted internally of the upper inner plate and the upper outer plate, respectively, when the upper case and the lower case are assembled with each other.

BRIEF DESCRIPTION OF THE DRAWINGS

The above object, and other features and advantages of the present invention will become more apparent by describing preferred embodiments thereof in detail with reference to the attached drawings, in which.

DESCRIPTION OF A PREFERRED EMBODIMENT

Hereinafter, a preferred embodiment of the present invention will be described in detail with reference to the accompanying drawings, and like elements will be numbered the same in the following description.

Figure 1:
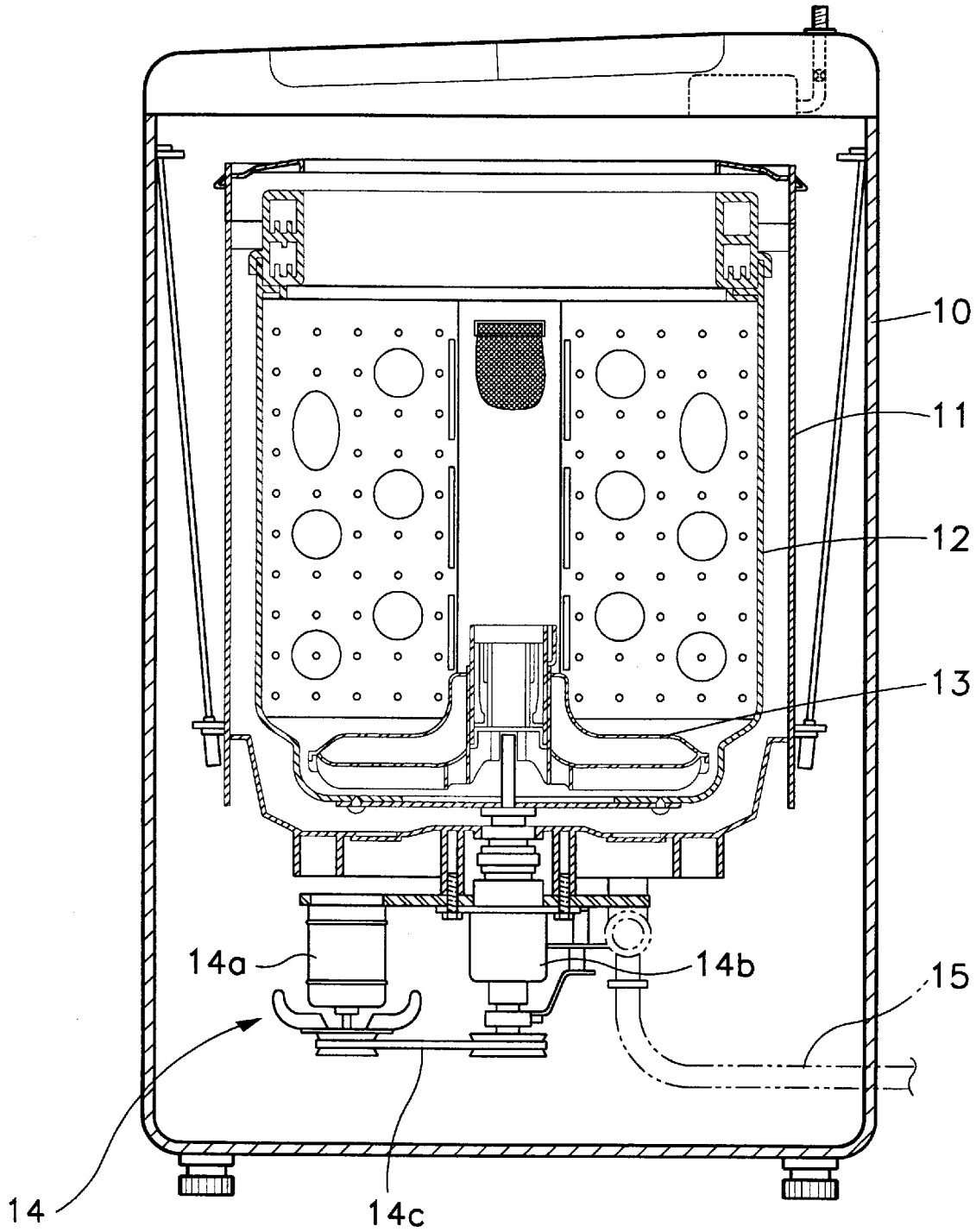
FIG. 1 (PRIOR ART)
FIG. 1 is a sectional view of a conventional washing machine for showing the inner construction thereof.
Figure 2:
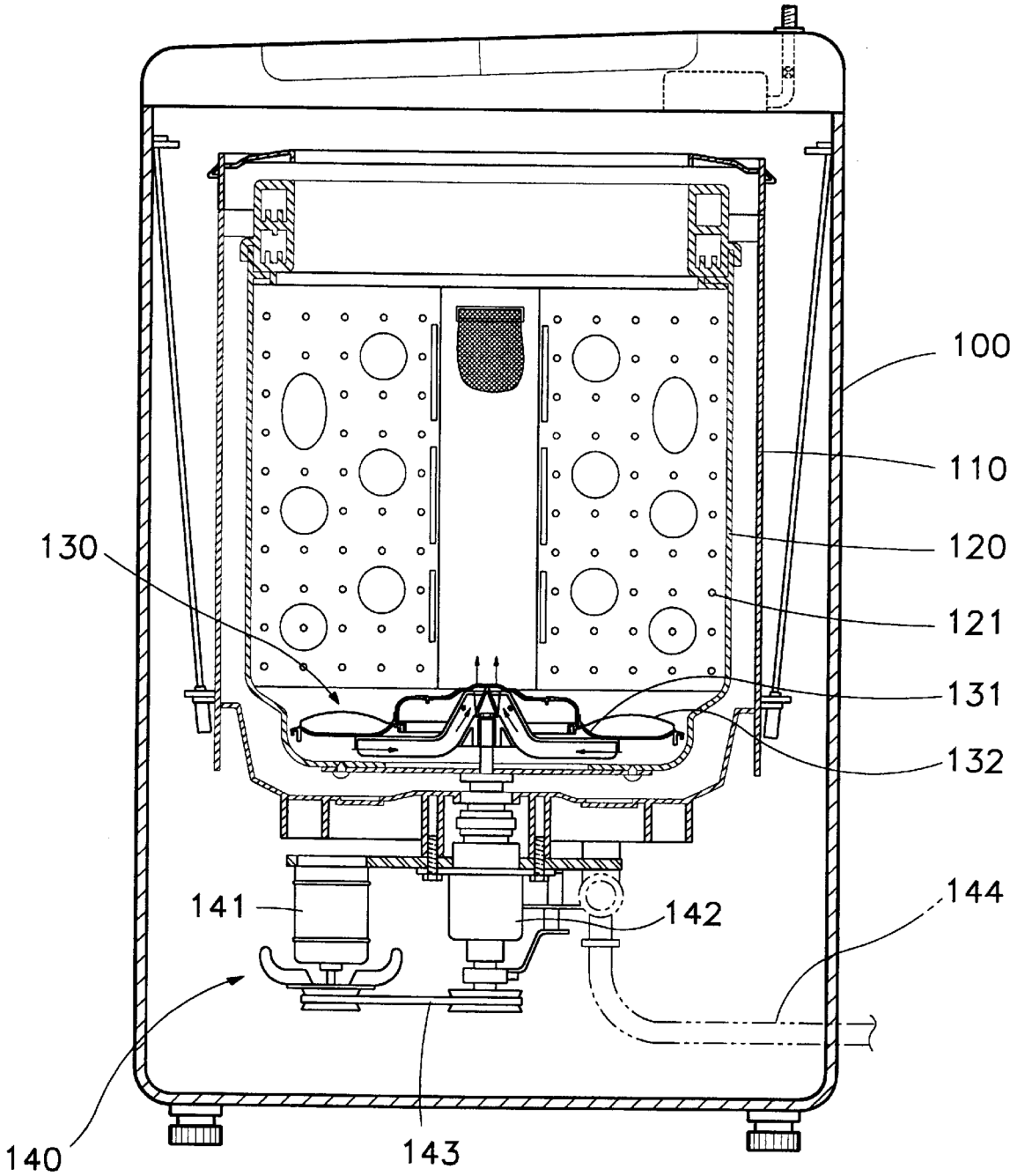
FIG. 2 is a sectional view of a washing machine according to an embodiment of the present invention, which shows the inner construction thereof.

FIG. 2 is a sectional view of a preferred embodiment of a washing machine according to the present invention, for showing the inner construction thereof.

As shown, the washing machine according to the present invention has a housing 100 forming the outer appearance of the washing machine. A control section (not shown) is arranged in an upper portion of the housing 100, and a tub 110 for containing the washing water is mounted in the housing 100. A spin basket 120 formed with a plurality of holes 121 is rotatably installed in the tub 110. On the bottom of the spin basket 120 is installed a pulsator 130 which includes a rotating plate 131 carrying a plurality of blades 132 arranged radially and protruding upward from the upper surface of the rotating plate 131. The pulsator 130 generates the washing current when it rotates in one direction or alternately is oscillated in opposite directions.

A driving mechanism 140 for driving the spin basket 120 and the pulsator 130 is arranged under the tub 110. The driving mechanism 140 includes a motor 141 and a transmission 142. The motor 141 produces the driving power, and the transmission 142 selectively rotates the pulsator 130 and the spin basket 120 by means of the rotating force of the motor 141 transferred through a belt 143. The transmission 142 rotates either the pulsator 130 alone, when the laundry is being washed, or it rotates the spin basket 120 and the pulsator 130 together when the laundry is being dehydrated (spin-drying). A drain hose 144 is provided at one side position under the tub 110 and extends out of the housing 100 to drain the washing water from the tub 110.

The pulsator 130 further includes a washing water spurting apparatus for spurting (ejecting) the washing water upwardly from the center of the pulsator to thereby prevent the laundry from being gathered and tangled.

Figure 3:
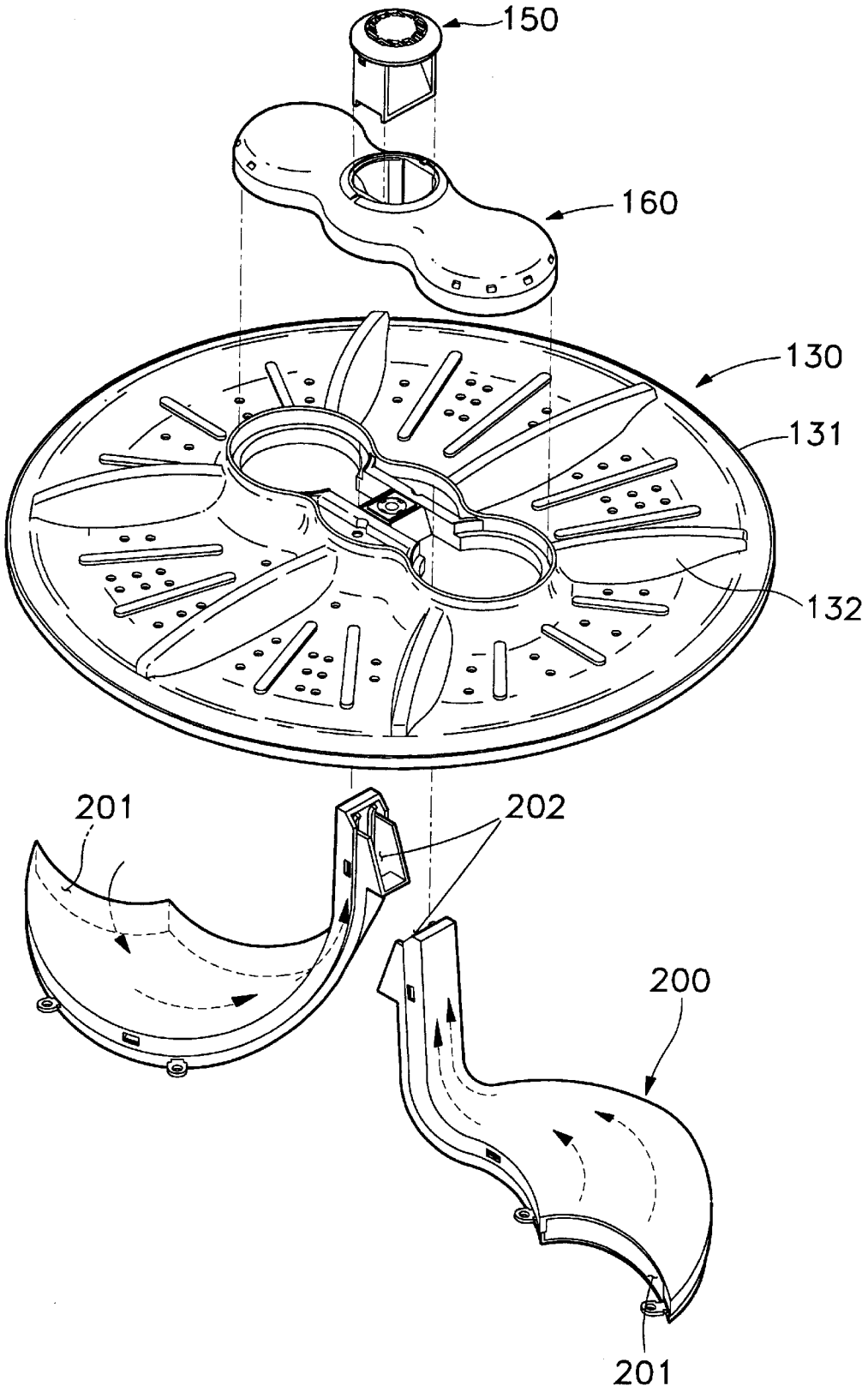
FIG. 3 is an exploded perspective view of a pulsator and a washing water spurting apparatus installed on the pulsator, which are employed in the washing machine shown in FIG. 2.

FIG. 3 is an exploded perspective view for showing in detail the construction of the pulsator and the washing water spurting apparatus according to the present invention.

The washing water spurting apparatus includes a guide duct 200 and a spurt cap 150. The guide duct 200 is fixed to the underside of the pulsator 130 so as to rotate together with the pulsator 130, thereby receiving washing water and guiding the washing water to the center of the pulsator 130. The spurt cap 150 is disposed at the center of the pulsator 130, so as to upwardly direct the washing water, guided by the guide duct 200, to a location above the center of the pulsator 130.

Although the washing water spurting apparatus may include only one guide duct 200, it is preferable to provide a pair of guide ducts 200 fixed to the pulsator 130 in opposing relationship to each other, in consideration of the space available for locating the guide ducts 200 and the need to keep the pulsator 130 dynamically balanced.

Each guide duct 200 has an inlet 201 formed at a radially outer end thereof and an outlet 202 formed at a radially inner end thereof. When the pulsator 130 rotates, the washing water is caused to enter the guide duct 200 through the inlet 201, and exit the guide duct 200 through the outlet 202 in an upward direction at the center of the pulsator 130. The cross sectional area of the guide duct 200 gradually decreases from the inlet 201 to the outlet 202, so that the flowing speed of the washing water increases as it goes from the inlet 201 to the outlet 202, whereby a strong upward spurt of the washing water occurs at the outlet 202. Further, the inlet 201 of the guide duct 200 faces in a horizontal direction, while the outlet 202 thereof faces upwardly.

Reference numeral 160 designates a supplementary blade. The spurt cap 150 is assembled with the blade 160, and the supplementary blade 160 rotates together with the pulsator 130 to make the vortex of the water current more violent.

Figure 4:
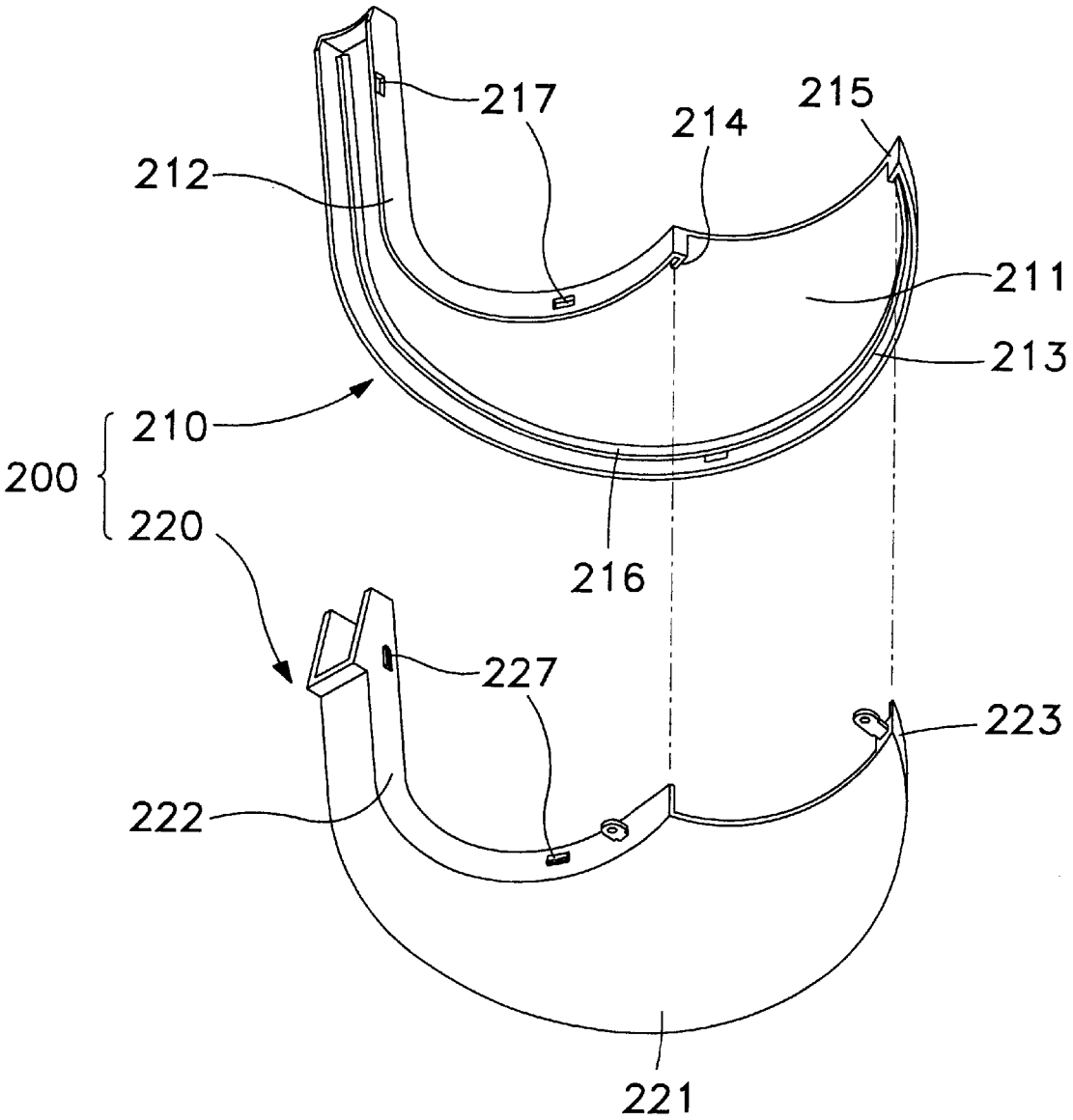
FIG. 4 is an exploded perspective view of a guide duct of the washing water spurting apparatus shown in FIG. 3.
Figure 5:
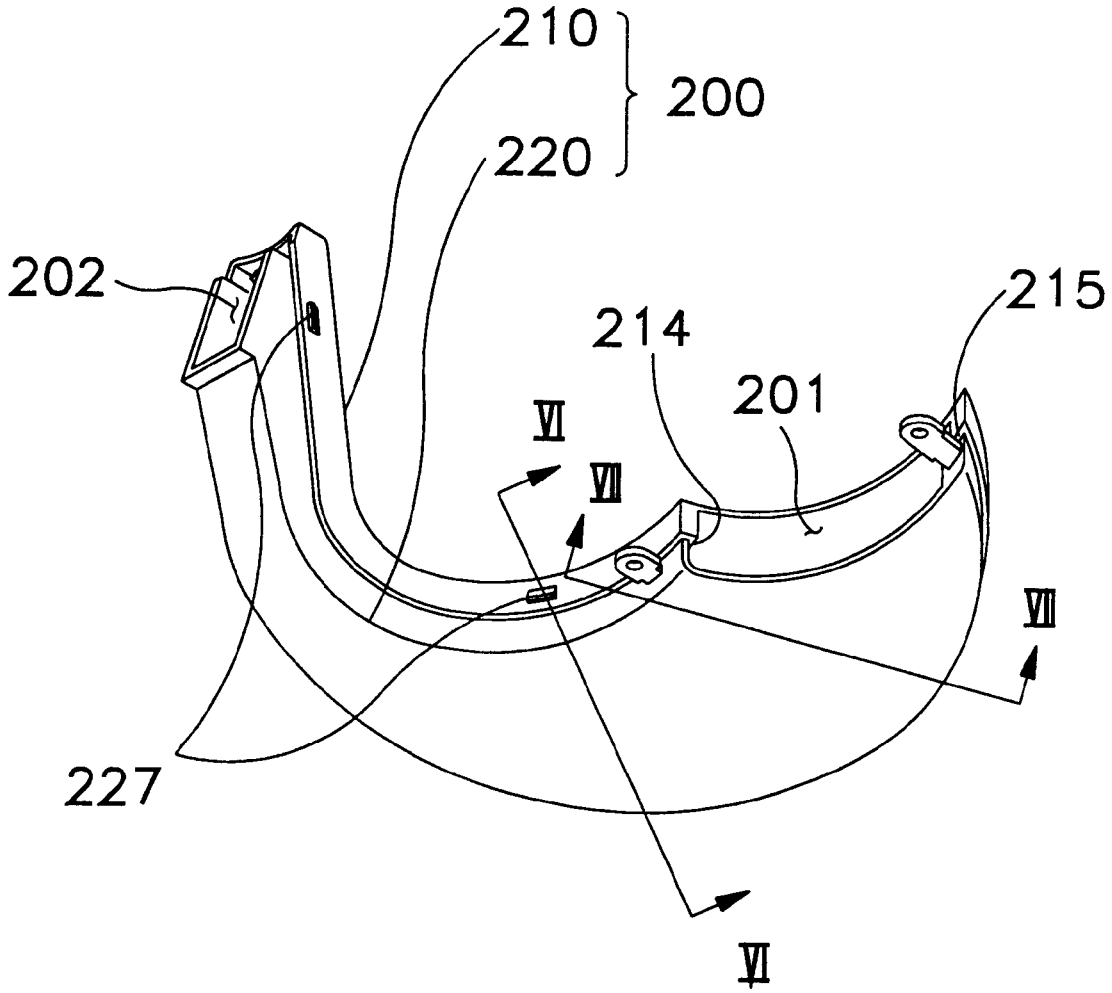
FIG. 5 is an assembled perspective view of the guide duct of FIG. 4.
Figure 6:
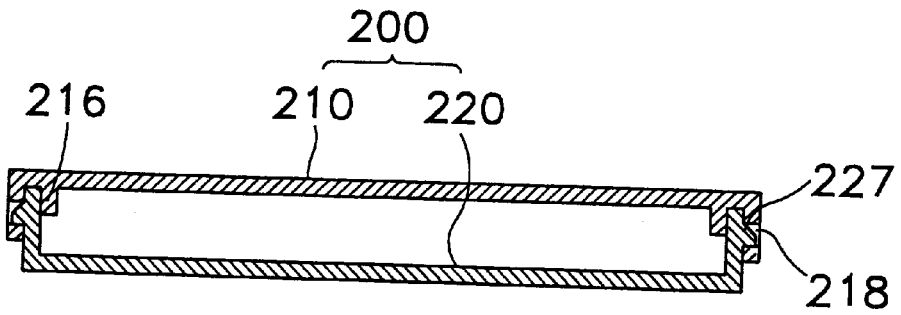
FIG. 6 is a sectional view of the guide duct, taken along line VI—VI in FIG. 5.
Figure 7:
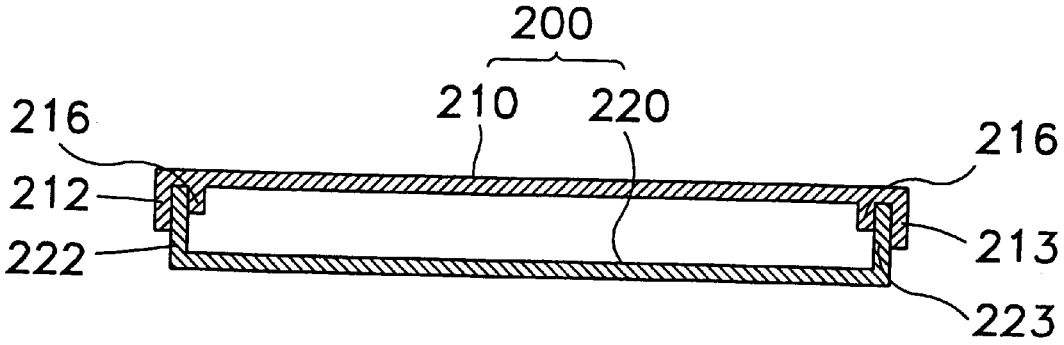
FIG. 7 is a sectional view of the guide duct, taken along line VII—VII in FIG. 5.

FIG. 4 is an exploded perspective view of a guide duct in the washing water spurting apparatus shown in FIG. 3, FIG. 5 is an assembled perspective view of the guide duct of FIG. 4, FIG. 6 is a sectional view of the guide duct, taken along line VI—VI in FIG. 5, and FIG. 7 is a sectional view of the guide duct, taken along line VII—VII in FIG. 5.

Referring to FIGS. 4 to 7, the guide duct 200 includes an upper case 210 and a lower case 220 detachably assembled with the upper case 210. The upper case 210 has a top plate 211, and an upper inner plate 212 and an upper outer plate 213, both of the plates 212, 213 forming downwardly depending side walls of the upper case 210. The lower case 220 has a bottom plate 221, and an lower inner plate 222 and an lower outer plate 223, both of the plates 222, 223 forming upwardly extending side walls of the lower case 220. The width of the lower case 220 is narrower than that of the upper case 210, so that the lower inner plate 222 and the lower outer plate 223 are inserted internally of the upper inner plate 212 and the upper outer plate 213, respectively, when the upper case 210 and the lower case 220 are assembled with each other to form the guide duct 200.

The guide duct 200 further includes a first assembling means for easily assembling and detaching the upper case 210 and lower case 220 with respect to each other. The first assembling means includes a plurality of insert holes 217 and a plurality of protuberances 227. The insert holes 217 are formed at the upper inner and outer plates 212 and 213 of the upper case 210, while the protuberances 227 are formed at predetermined positions of the inner and outer lower plates 222 and 223 corresponding to the locations of the insert holes 217. That is, when the upper case 210 and the lower case 220 are assembled together, since the narrower lower case 220 is inserted in the broader upper case 210, the protuberances 227 are easily inserted in the insert holes 217. Also, when the upper case 210 and the lower case 220 are detached from each other, the protuberances 227 can be easily separated out of the insert holes 217.

In the meantime, in the guide duct 200 as constructed above, means is provided for preventing foreign matter such as waste threads entrained in the washing water from entering a gap formed between the upper case 210 and the lower case 220, which matter could disturb the flow of the washing water. In that regard, inner and outer bent portions 214 and 215 are provided on opposite sides of a water inlet portion of the lower inner plate 222. The inner and outer bent portions 214 and 215 respectively extend from the upper inner plate 212 and the upper outer plate 213 in such a manner to have a shape corresponding to that of the lower inner plate 222 and the lower outer plate 223. That is, the inner bent portion 214 has a C-shape to surround a corresponding end of the lower inner plate 222, and the outer bent portion 215 has a shape of a V-shape to surround the corresponding end of the lower outer plate 223. These shapes prevent the washing water from entering any gap formed between the plates 212 and 222 on the one hand, and the plates 213 and 223 on the other hand. Rather, the washing water smoothly enters the inlet 201.

Further, in order to prevent the washing water and foreign matter in the guide duct 200 from entering gaps formed between the top plate 211 of the upper case 210 and the upper ends of the lower inner and outer plates 222 and 223, ribs 216 protrude downwardly from the inner surface of the top plate 211 of the upper case 210. As shown in FIGS. 4 and 7, the ribs 216 are parallel to, and spaced apart from, the upper inner plate 212 and the upper outer plate 213 to form channels therewith. The lower inner plate 222 and the lower outer plate 223 are tightly fitted in respective ones of the channels (see FIG. 7). Accordingly, the ribs 216 prevent foreign matter from traveling between the rib 216 and the upper inner and outer plates 212 and 213 to thereby maintain the interior of the guide duct 200 clean.

Figures 8, 8A, 8B, 8C, 8D:
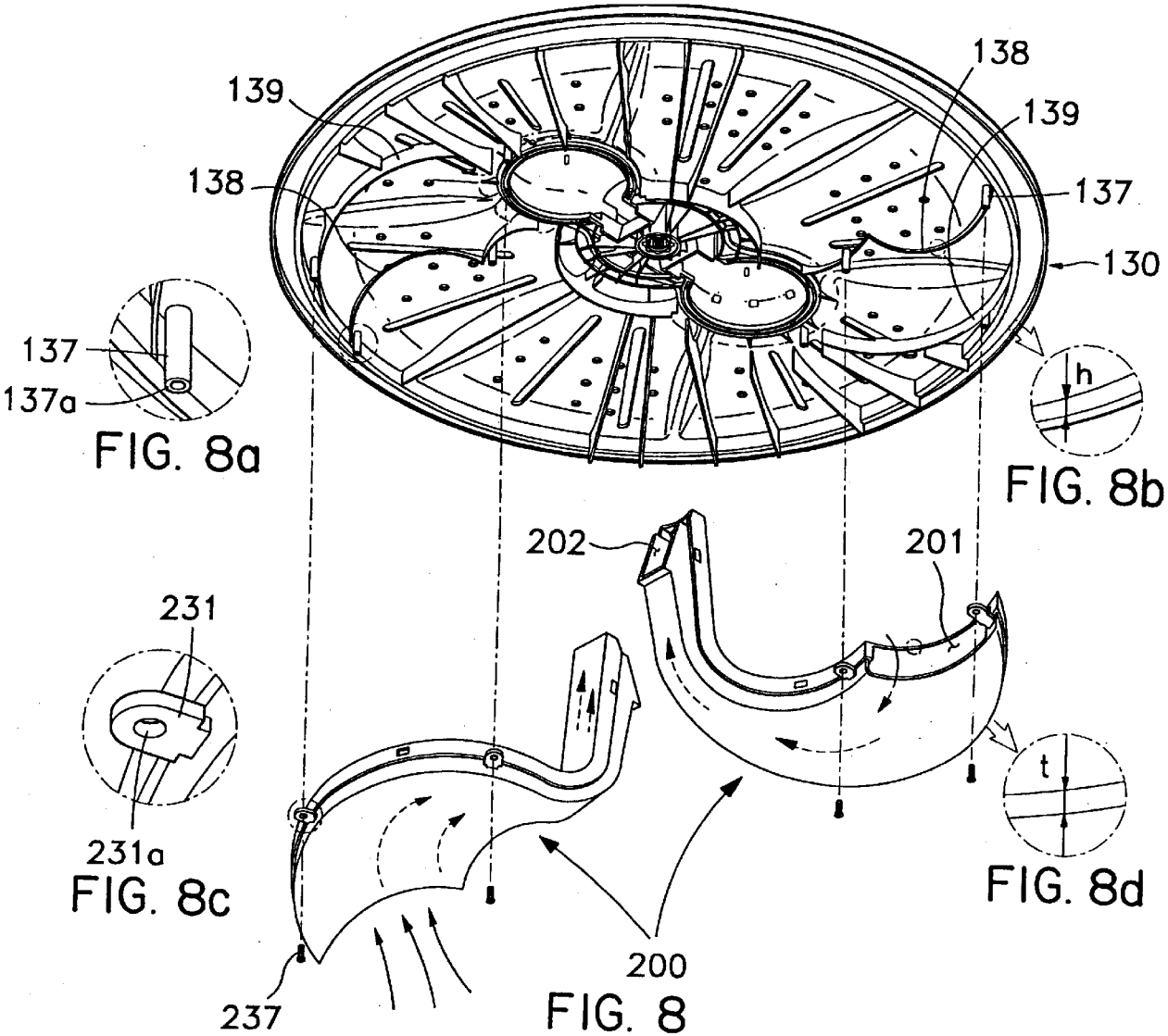
FIG. 8 is an exploded perspective view of the pulsator and the guide ducts of FIG. 4, for showing the manner of assembling them.
FIG. 8*a* and 8*b* are enlarged fragmentary views of respective circled portions of the pulsator.
FIG. 8*c* and 8*d* are enlarged fragmentary views of respective circled portions of the ducts.
Figure 9:
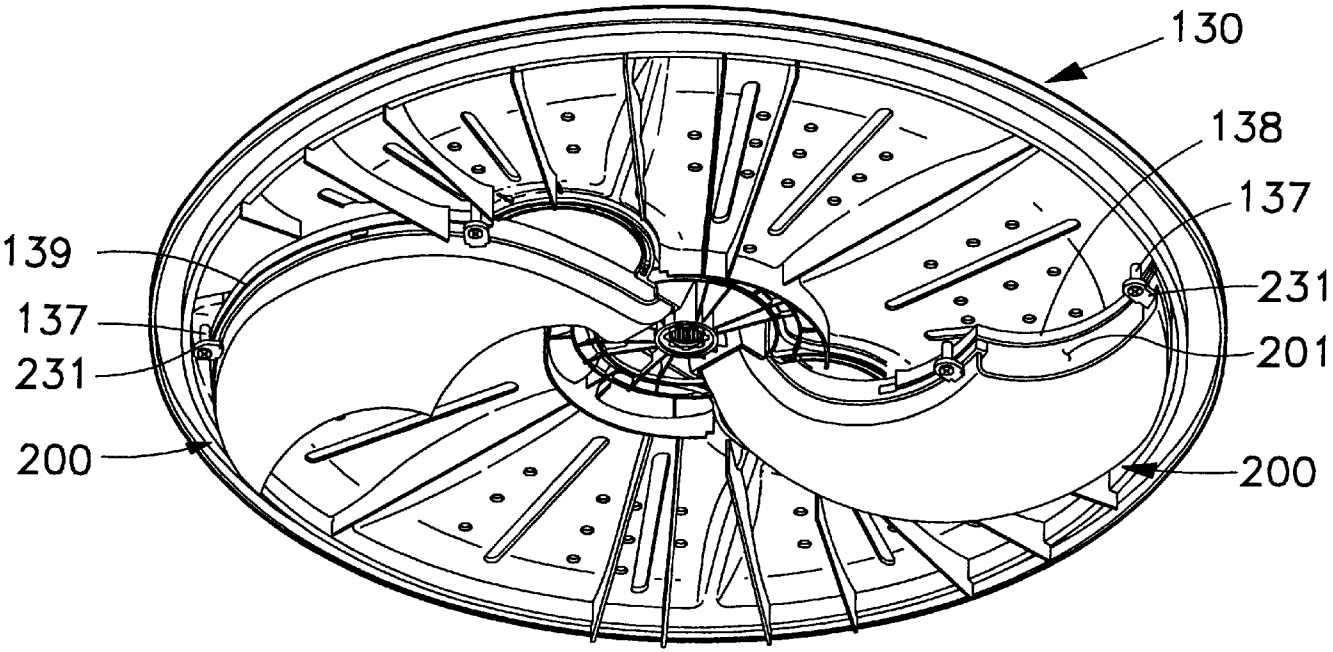
FIG. 9 is a bottom perspective view of the pulsator and the guide ducts of FIG. 8, which are assembled with each other.

FIG. 8 is an exploded perspective view of the pulsator and the guide ducts of FIG. 4, for showing the manner of assembling them, and FIG. 9 is a perspective view of the pulsator and the guide ducts of FIG. 8, which are assembled with each other. Referring to FIGS. 8 and 9, a second assembling means for assembling the guide ducts with the pulsator will be described hereunder.

The second assembling means includes a plurality of assembling brackets 231 (FIG. 8*c*) and a plurality of assembling pins 137 (FIG. 8*a*). The assembling brackets 231 are formed on the lower inner plate 222 and the lower outer plate 223 of the guide duct 200. The assembling pins 137 protrude downwardly from predetermined positions of the lower surface of the pulsator 130 corresponding to the positions of the assembling brackets 231. The assembling brackets 231 and the assembling pins 137 respectively have screw holes 231*a* and 137*a* through which screws are assembled.

The pulsator 130 has guide ribs 138 and 139 projecting downwardly from the lower surface thereof. The guide ribs 138 and 139 define the assembling positions for the guide duct 200, and at the same time prevent foreign matter from traveling between the guide duct 200 and the pulsator 130 because they have the same shape of the outer contour of the guide duct 200. Meanwhile, the guide rib 138 which defines the position of the inlet 201 of the guide duct 200 must be arranged so as not to block off the water inlet 201. That is, the guide rib 138 of the inlet 201 side must have a height h (FIG. 8*b*) not much larger than the thickness t (FIG. 8*d*) of the plate 211 of the guide duct 200, so that the washing water may be smoothly introduced into the inlet 201 (see also FIG. 9).

When the pulsator 130 and the guide duct 200 are assembled by the second assembling means as described above, the guide duct 200 is firstly located beneath the lower surface of the pulsator 130 in alignment with the guide ribs 138 and 139. Thereafter, screws 237 are assembled into the screw holes 231*a* of the assembling brackets 231 and the screw holes 137*a* of the assembling pins 137, so that the guide duct 200 is firmly installed to the lower surface of the pulsator 130.

Figure 10:
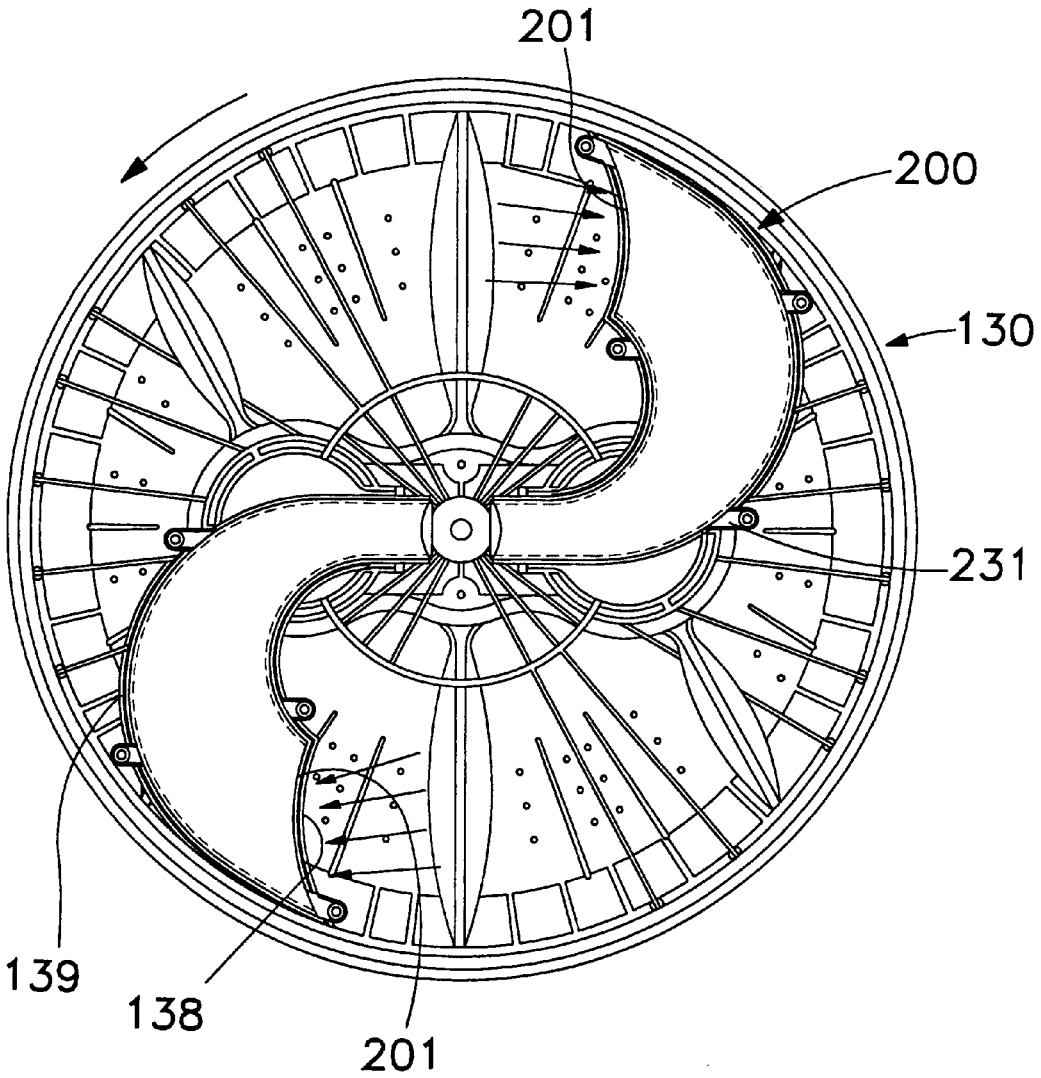
FIG. 10 is a bottom view of the pulsator of FIG. 9.

FIG. 10 is a bottom view of the pulsator of FIG. 9, with which the guide ducts are assembled. Referring to FIGS. 2, 3 and 7, the operation of the washing machine according to the present invention will be described hereinafter.

First, when the washing machine is driven by operating the control section (not shown) after putting the laundry in the spin basket 120, the washing water is introduced into the spin basket 120 and simultaneously into the guide duct 200. Thereafter, an electric power is applied to the motor 141, whereupon the transmission 142 rotates the pulsator 130 in one direction, or alternately oscillates the pulsator in opposite directions, by means of the rotating force transferred from the motor 141. In this case, the guide duct 200 fixed to the lower surface of the pulsator 130 rotates together with the pulsator 130. When the pulsator 130 rotates counterclockwise as shown in FIG. 10, the washing water continuously flows into the guide duct 200 through the inlet 201. The washing water introduced into the guide duct 200 as described above goes on flowing in the guide duct 200 and then spurts upwardly from the center of the pulsator 130 through the outlet 202. In the meantime, as described above, since the cross sectional area of the guide duct 200 narrows from the inlet 201 to the outlet 202, the washing water flows gradually faster to eventually achieve a strong spurt through the outlet 202 and the spurt cap 150. Therefore, the laundry gathered above the center of the pulsator 130 during the washing can be dispersed by the strong spurt of the washing water, thereby preventing the laundry from being tangled and damaged. Also, the spurting washing water applies an impact to the laundry to thereby improve the washing performance of the washing machine.

Moreover, the washing machine reveals a further advantage of easy fabrication, in that the upper case and the lower case of the guide duct can be easily assembled and detached to and from each other. Furthermore, in the washing machine, the foreign matter is prevented from entering gaps formed between the upper and lower cases and in the contact portion between the guide duct and the pulsator. Thus, the washing water can smoothly enter the guide duct, and the interior of the guide duct can be maintained clean.

In addition, when the guide duct is being installed to the pulsator, after the guide duct has been located at the guide ribs formed at the lower surface of the pulsator, they can be assembled with screws. Therefore, a further advantage of easy installation of the guide duct to the pulsator is provided by the present invention.

While the present invention has been particularly shown and described with reference to the particular embodiment thereof, it will be understood by those skilled in the art that various changes in form and details may be effected therein without departing from the spirit and scope of the invention as defined by the appended claims.

What is claimed is:

1. A clothes washing machine comprising:

a housing;

a spin basket mounted in the housing;

a pulsator rotatably mounted at a bottom of the spin basket; and a washing water spurting apparatus including at least one guide duct and a spurt cap, the guide duct being disposed on an underside of the pulsator to rotate together with the pulsator for guiding washing water from an inlet of the guide duct toward an outlet thereof located at a center of the pulsator where the washing water exits the guide duct, the spurt cap being disposed at the center of the pulsator to guide the exiting washing water upwardly from the center of the pulsator;

wherein the guide duct comprises an upper case, a lower case, and an assembling means for assembling and detaching the upper case and the lower case to and from each other.

2. The clothes washing machine as claimed in claim 1, wherein the upper case comprises a top plate, an upper inner plate and an upper outer plate; the upper inner plate and the upper outer plate forming downwardly depending side walls of the upper case; the lower case having a bottom plate, a lower inner plate, and a lower outer plate; the lower inner plate and the lower outer plate forming upwardly extending side walls of the lower case; the lower inner plate and the lower outer plate being inserted internally of the upper inner plate and the upper outer plate, respectively, when the upper case and the lower case are assembled with each other.

3. The clothes washing machine as claimed in claim 2, wherein the assembling means comprises a plurality of insert holes and a plurality of protuberances, the insert holes being formed on the upper inner plate and the upper outer plate of the upper case; the protuberances being formed on the inner lower plate and the outer lower plate of the lower case at locations corresponding to locations of the insert holes, so that the protuberances are detachably assembled in the insert holes.

4. The clothes washing machine as claimed in claim 3, wherein the upper inner plate has a first bent portion and the upper outer plate has a second bent portion; the first bent portion surrounding an end of the lower inner plate, the second bent portion surrounding an end of the lower outer plate; the first and second bent portions arranged for preventing foreign matter from traveling between the upper inner plate and lower inner plate, and between upper outer plate and the lower outer plate.

5. The clothes washing machine as claimed in claim 3, wherein the upper case has ribs depending downwardly from the top plate of the upper case; the ribs being spaced apart from the upper inner plate and the upper outer plate, respectively, to form channels in which the lower inner plate and the lower outer plate are tightly fitted.

6. The clothes washing machine as claimed in claim 2, wherein the assembling means comprises a first assembling means; the machine further comprising a second assembling means for affixing the guide duct to the underside of the pulsator so that the guide duct rotates together with the pulsator.

7. The clothes washing machine as claimed in claim 6, wherein the second assembling means comprises a plurality of assembling brackets and a plurality of assembling pins; the assembling brackets being formed on the lower inner plate and the lower outer plate; the assembling pins protruding from the lower surface of the pulsator at locations corresponding to locations of the assembling brackets.

8. The clothes washing machine as claimed in claim 7, wherein the assembling brackets and the assembling pins respectively have screw holes through which screws are assembled.

9. The clothes washing machine as claimed in claim 6, wherein the pulsator further comprises guide ribs depending downwardly from the underside of the pulsator; the guide ribs defining positions at which the guide duct is to be assembled; a portion of each guide rib extending across a top of a water inlet of the duct to prevent foreign matter from traveling between the duct and the underside of the pulsator.

10. The clothes washing machine as claimed in claim 1, further comprising a second assembling means for affixing the guide duct to the underside of the pulsator so that the guide duct rotates together with the pulsator.

11. The clothes washing machine as claimed in claim 10 wherein the pulsator further comprises guide ribs depending downwardly from the underside of the pulsator; the guide ribs defining positions at which the guide duct is to be assembled; a portion of each guide rib extending across a top of a water inlet of the duct to prevent foreign matter from traveling between the duct and the underside of the pulsator.

* * * * *

UNITED STATES PATENT AND TRADEMARK OFFICE

CERTIFICATE OF CORRECTION

PATENT NO. : 5,906,116

DATED : May 25, 1999

INVENTOR(S) : Young-Chul KIM; Jae-Ryoung PARK

It is certified that error appears in the above-identified patent and that said Letters Patent is hereby corrected as shown below:

Column 1, insert the following:

--[30] Foreign Application Priority Data

June 30, 1997 [KR] Rep. of Korea.....97-29000

June 30,1997 [KR] Rep. of Korea.....97-29001

June 30, 1997 [KR] Rep. of Korea.....97-29003--

Signed and Sealed this

Eleventh Day of January, 2000

*Attest:*

*Attesting Officer*

Q. TODD DICKINSON

*Acting Commissioner of Patents and Trademarks*